US006155557A

United States Patent [19]

Suzuki

[11] Patent Number: 6,155,557

[45] Date of Patent: Dec. 5, 2000

[54] SHEET FEEDING DEVICE

[75] Inventor: Nobutaka Suzuki, Tokyo, Japan

[73] Assignee: Ricoh Company, Ltd., Tokyo, Japan

[21] Appl. No.: 09/215,549

[22] Filed: Dec. 18, 1998

[30] Foreign Application Priority Data

Feb. 4, 1998 [JP] Japan ..... 10-023480
Dec. 3, 1998 [JP] Japan ..... 10-344432

[51] Int. Cl.[7] ..... B65H 3/06

[52] U.S. Cl. ..... 271/119; 271/208; 271/109; 361/214; 361/221; 492/54; 492/25; 492/38

[58] Field of Search ..... 271/119, 109, 271/208; 361/214, 221; 492/54, 25, 38

[56] References Cited

U.S. PATENT DOCUMENTS

| | | | |
|---|---|---|---|
| 1,559,785 | 11/1925 | Russell | 361/214 |
| 3,268,766 | 8/1966 | Amos | 361/221 X |
| 4,618,134 | 10/1986 | Kawaguchi et al. | 271/4 |
| 4,858,907 | 8/1989 | Eisner et al. | 271/124 |
| 5,347,347 | 9/1994 | Hilbert et al. | 355/253 |
| 5,455,514 | 10/1995 | Pazda et al. | 361/214 X |
| 5,601,913 | 2/1997 | Ohtani et al. | 361/214 X |
| 5,621,451 | 4/1997 | Sugiura et al. | 347/112 |
| 5,689,794 | 11/1997 | Kondo | 399/388 |

FOREIGN PATENT DOCUMENTS

| | | | |
|---|---|---|---|
| 3-116325 | 12/1991 | Japan . | |
| 4-85223 | 3/1992 | Japan | 271/119 |

OTHER PUBLICATIONS

Patent Abstracts of Japan, Publication No. 10095540, Apr. 14, 1998.

Patent Abstracts of Japan, Publication No. 3–13442, Jan. 22, 1991.

*Primary Examiner*—Christopher P. Ellis
*Assistant Examiner*—Richard Ridley
*Attorney, Agent, or Firm*—Oblon, Spivak, McClelland, Maier & Neustadt, P.C.

[57] ABSTRACT

A member for feeding sheets is provided with a core and a cover mounted on the core. The cover is made of a conductive material or one whose coefficient of friction is lower than that of the sheets.

15 Claims, 5 Drawing Sheets

SHEET FEEDING DEVICE

BACKGROUND OF THE INVENTION

1. Field of the Invention

The present invention relates to a sheet feeding device including a sheet feed member. It is based upon Japanese Application no. 10-23480 filed on Feb. 4, 1998 and Japanese Application no. 98-6873 filed on Dec. 3, 1998, both of which are hereby incorporated by reference.

2. Discussion of the Background

An image forming apparatus (e.g., copiers, facsimiles, printers or similar image forming apparatus) uses various kinds of sheet feeding devices. For example, a sheet feed member may cooperate with a friction pad feed system to feed sheets by using a frictional force between the sheet feed member and the friction pad. Japanese Laid-Open Patent Publication No. 3-116325 discloses such a sheet feed mechanism having a plurality of cams which are coaxially fixed to both ends of a sheet feed roller. However, that configuration requires the presence of a part devoted exclusively thereto, and so the cost of the apparatus inevitably increases.

In the above sheet feed mechanism, the cams separate the sheet feed roller from a friction pad after a part of a top sheet fed from a stack and contacts the friction pad. A trailing edge of the top sheet is held between the friction pad and the sheet feed roller. However, it is possible that the sheet may be improperly fed because of a change in a state of contact against the sheet.

Moreover, as shown in FIG. 11 and FIG. 12, it is possible that the sheet P, which is fed by the sheet feed roller 1 and the friction pad 3, may be frictionally charged by the cams 2, and a toner image may be improperly transferred (e.g., transfer hollow) on the sheet P.

SUMMARY OF THE INVENTION

The present invention has been made in view of such problems and addresses efficiencies in known systems.

Accordingly, it is an object of the present invention to provide a novel sheet feeding device having a stable sheet feeding, image transferring and inexpensive configuration.

According to a feature of the invention, the above and other objects are achieved by a member for feeding sheets and comprising a core, a surface portion formed on the core so as to be rotatable, at least one portion of the circumferential extent of the surface portion being made of a material whose coefficient of friction is lower than that of sheets to be fed and at least another portion of the circumferential extent the surface portion being made of a material whose coefficient of friction is higher than that of the sheets.

According to another feature of the invention, the above and other objects are achieved by a member for feeding sheets comprising a core having a surface portion, at least a portion of the surface portion being made of a conductive material.

According to yet another feature of the invention, the above and other objects are achieved by a sheet feeding device comprising a cassette to hold a stack of sheets; a sheet feed member mounted so as to feed sheets one by one from said cassette, said sheet feed member including a core and a surface portion formed on said core so as to be rotatable, said surface portion having at least one circumferential portion being made of a material whose coefficient of friction is lower than that of sheets; and a friction member to pressed against said sheet feed member.

According to yet another feature of the invention, the above and other objects are achieved by a sheet feeding device comprising cassette to hold a stack of sheets; a sheet feed member mounted so as to feed sheets one by one from said cassette, said sheet feed member including a core and a surface portion formed on said core so as to be rotatable, said surface portion having at least one circumferential portion being made of a conductive material; and a friction member mounted so as to be pressed against said sheet feed member.

BRIEF DESCRIPTION OF THE DRAWINGS

The above and objects, features and advantages of the present invention will become more apparent from the following detailed taken with the accompanying drawings in which.

DESCRIPTION OF THE PREFERRED EMBODIMENTS

The present invention is explained in detail hereinafter by the embodiments shown in the accompanied drawings.

Figure 1:
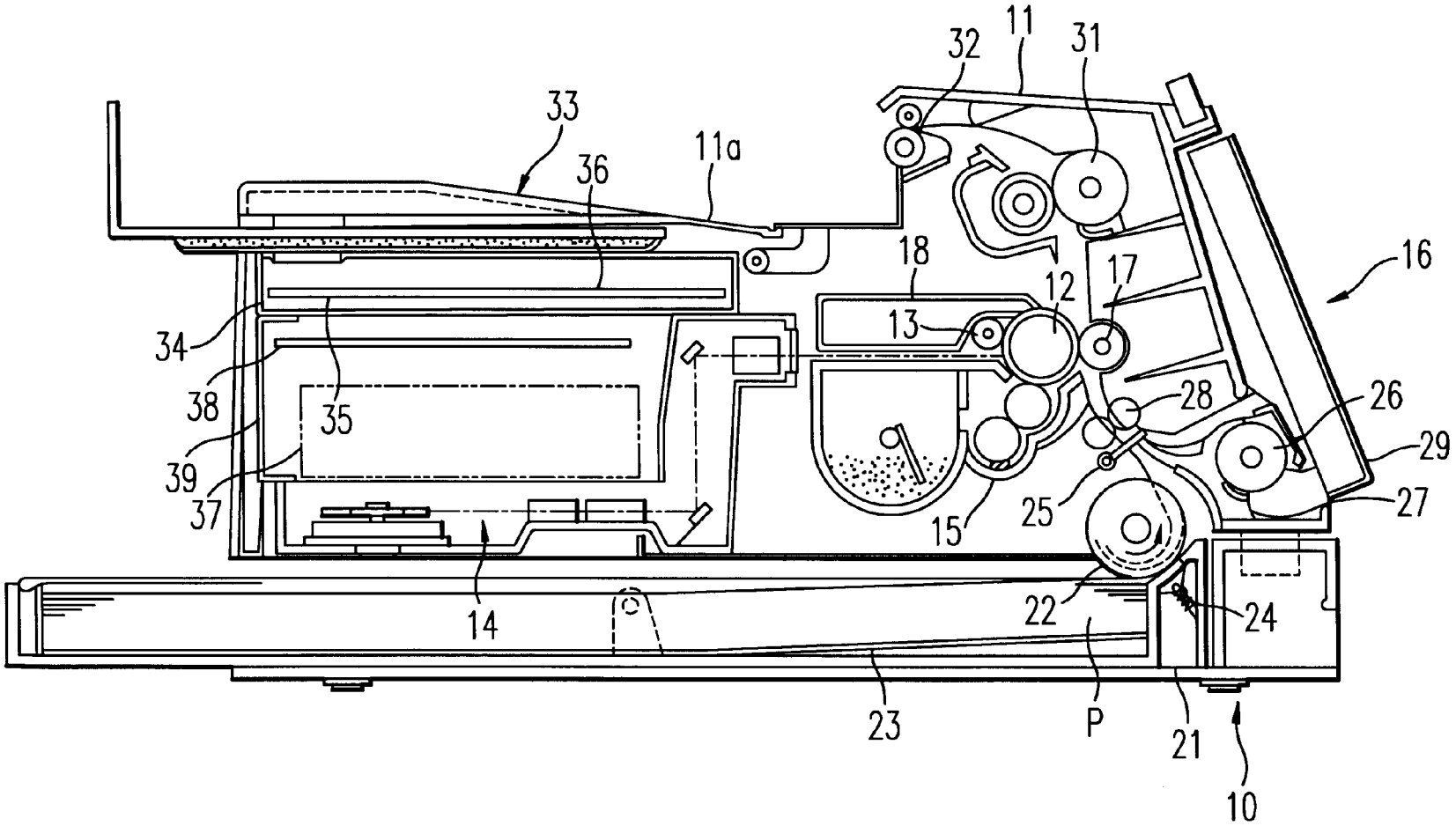
FIG. 1 is a schematic sectional drawing illustrating a main structure of a laser printer as an image forming apparatus in an embodiment according to the present invention, from the front side.

FIG. 1 shows a laser printer of an image forming apparatus in an embodiment of the present invention. As shown, the laser printer 11 as the image forming apparatus includes a photoconductive member 12 (e.g., a drum or a belt) which is located in the middle of the laser printer 11. A charge device 13 (e.g., a charge roller, a blade, a belt or a brush) charges the surface of the photoconductive member 12. A writing device 14 forms an electrostatic latent image. A developing device 15 develops the electrostatic latent image.

A transfer device 17 (e.g., a transfer roller, a blade, a belt or a brush) transfers a toner image from the photoconductive member 12 to a sheet P. A cleaning device 18 cleans residual toner from the surface of the photosensitive member. A sheet-feeding device 10 or a by-pass-feeding device 16 feed the sheet P past the photoconductive member to form an image thereon. Sheets stored in the sheet-feeding device 10 may be fed thereby. Alternatively, non-standard paper sheets may be fed from the by-pass-feeding device 16.

The sheet-feeding device 10 is provided with a cassette 21 that holds a stack of the sheets P, a sheet feed member 22 (called a roller 22) that feeds the sheets P from the cassette 21, a bottom plate 23 that is rotatably mounted and presses the leading edge of the sheet stack against the sheet feed roller 22 with a preselected pressure, and a friction member 24 (called a friction pad 24) that presses against the sheet feed roller 22. The sheet feed member described above is implemented as the roller 22, but it may instead be implemented as a belt or similar member if desired. The friction member described above is implemented as the pad 24, but it may be implemented as a belt, a roller or similar member if desired.

A pair of registration rollers 28 and a registration sensor 25 which are located between the sheet feed roller 22 and the transfer device 17 set feeding timing of the sheet P to a transfer area in which the photoconductive member 12 and the transfer device 17 are facing each other in synchronism with the image on the photoconductive member 12.

The by-pass-feeding device 16 is provided with a by-pass feed table 29, a by-pass sheet feed roller 26, and a by-pass friction pad 27. The by-pass sheet feed roller 26 has the same structure as the sheet feed roller 22.

A fixing device 31, which is located above the photoconductive member 12, fixes the toner image on the sheet P. A pair of discharge rollers 32 discharges the sheet P fixed the image into a stack tray 33 which is located at an upper part of a cover 11*a*.

A control device 35 which is located below the stack tray 33 is provided with a control board 36. Various switches and control units, not shown, are arranged on the control board 36. A power source 37, the writing device 14 and a case 39 storing a circuit board 38 are located below a case 34 holding the control board 36.

The image forming operation will be described hereinafter.

A laser beam which issues from the writing device 13 scans the charged surface of the photoconductive member 12, thus forming an electrostatic latent image in accordance with image data. The developing device 15 develops the latent image with toner, thus forming a toner image on the photoconductive member 12.

When the sheet feed roller 22 starts rotating, it grips a top sheet P of the sheet stack, and sends out the sheets P contained the cassette 21 to the registration rollers 28, one by one. The registration rollers 28 control when the sheet P is to be fed to the transfer area, and sends it out.

When the sheet P passes through the transfer area, the transfer device 17 transfers the toner image from the photoconductive member 12 to the sheet P by using an electric field which is formed between the photoconductive member 12 and the transfer device 17. The fixing device 31 fixes the toner image on the sheet P with heat and pressure. The discharge rollers 32 discharge the sheet P fixed with the toner image into the stack tray 33.

Further, the by-pass sheet feed roller 26 and the by-pass friction pad 27 also send out a top sheet P of the sheet stack held at the-by-pass feed table 29 to the registration rollers 28 one by one.

Figure 2:
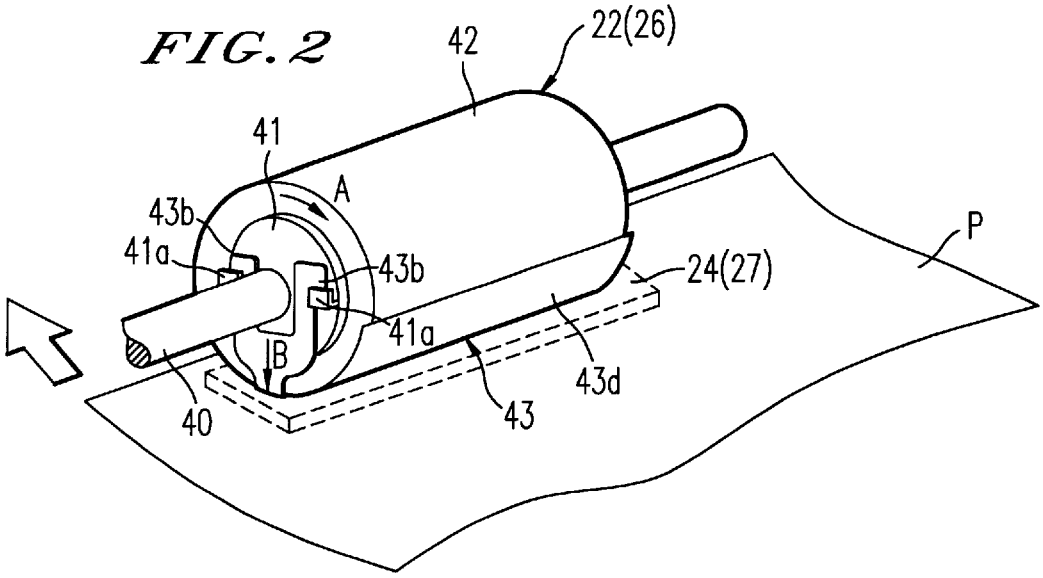
FIG. 2 is an enlarged perspective drawing illustrating a sheet feed device according to the invention.
Figure 3A:
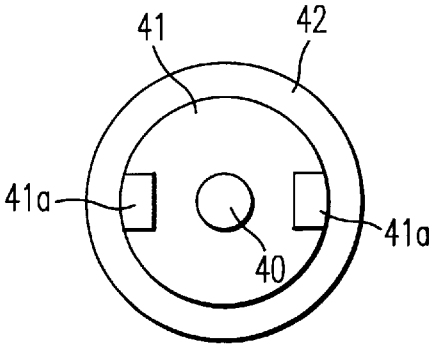
FIGS. 3(*a*) and (*b*) are schematic drawings illustrating a state where a cover is removed from a sheet feed roller, from the front and side.
Figure 3B:
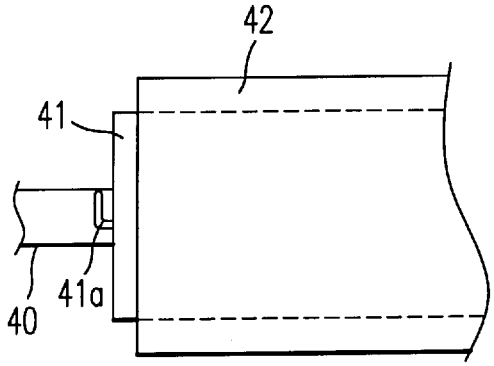
Figure 4A:
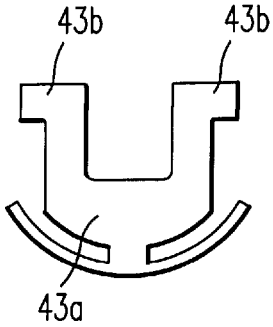
FIGS. 4(*a*) and (*b*) are schematic drawings illustrating the cover from the front and side.
Figure 4B:
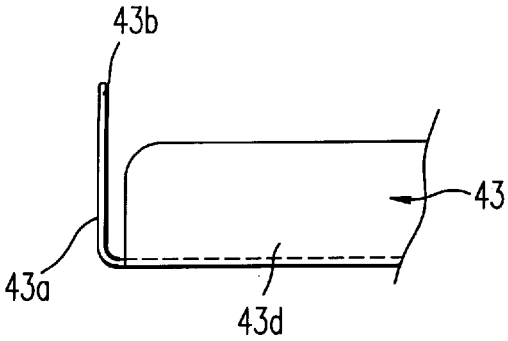

FIG. 2 shows the roller structure of the sheet-feeding device 10 or the by-pass-feeding device 16. FIGS. 3(*a*) and (*b*) are end and side views showing the sheet feed roller 22 or the by-pass-feed roller 26 with the covering member 43 removed, from the front and side. FIGS. 4(*a*) and (*b*) show the covering member 43 from the front and side.

The sheet-feeding device will be described hereinafter.

The sheet feed roller 22 or the by-pass sheet feed roller 26 has a shaft 40 made of resin or similar material, a core 41 formed on the shaft 40 and made of the same material as one body, a rotary body 42 which is a columnar roll formed on the core 41, and the covering member 43 (called the cover 43) which is fixed on a part of a surface of the rotary body 42.

The rotary body 42 is made of rubber or similar material having a high friction coefficient (e.g., a coefficient of friction $\mu 1$ of 0.8 to 3.0) against the sheet P (e.g., having a coefficient of friction $\mu 2$ of 0.6 to 0.7) in order to surely feed the sheet P. The cover 43 is made of metal, resin, ceramics, glass or similar material having a low friction coefficient (e.g., a coefficient of friction $\mu 3$ of 0.01 to 0.5) against the sheet P in order to smoothly feed the sheet P. Namely, the sheet feed roller 22 or roller 26 has at least one portion whose coefficient of friction is lower than that of the sheet and at least one portion whose coefficient of friction is higher than that of the sheet (e.g., $\mu 3 < \mu 2 < \mu 1$). Thus, at least one portion of the circumferential extent of the surface portion is made of a material whose coefficient of friction is lower than that of sheets to be fed and at least another portion of the circumferential extent the surface portion is made of a material whose coefficient of friction is higher than that of the sheets.

The cover 43 has been described as being applied to either the sheet feed roller 22 or the by-pass sheet feed roller 26, but it is preferably applied to only the by-pass sheet feed roller 26.

Moreover, the rotary body described above has a high frictional portion and a low frictional portion, but it may have more than two portions, if desired.

The cover 43 may be made of an electrically conductive material, e.g., metal, resin, ceramics or similar material having a low electric resistance (e.g., having an electric resistance of $1 \times 10^{12}\Omega$ or less (JISK6911)) in order to prevent the sheet P from being frictionally charged by the rotary body 42. The surface resistance is determined according to "resistivity" defined in JIS K 6911. Namely, the sheet feed roller 22 or roller 26 has at least one conductive surface portion. Moreover, the rotary body described above has a conductive portion, but it may have more than two conductive portions, if desired.

The cover 43 has a fan-shaped portion 43*d* extending along the surface of the roller portion 42 and two planar pieces 43*a* having an edge curved in correspondence with the shape of the fan-shape portion 43*d*. The planar pieces 43*a* are each formed with two-forked portions, which have projections 43*b* at each end.

Two engaging portions 41*a*, that engage with the projections 43*b*, are formed on each end of the core 41. The two engaging portions 41*a* engage with the projections 43*b*. The elastic rotary body 42 thus presses against the cover 43 in a direction indicated by an arrow B (see FIG. 2). Consequently, the cover 43 is fixed on the surface of the rotary body 42. Further, the cover 43 may be detached from the rotary body 42, if desired by unhooking the projections 43*b* from the engaging portions 41*a*.

Figure 5:
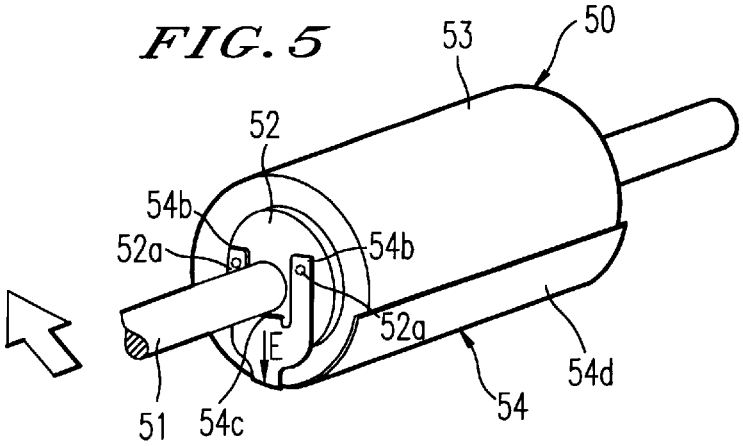
FIG. 5 is an enlarged perspective drawing illustrating a sheet feed device of a second embodiment.
Figure 6A:
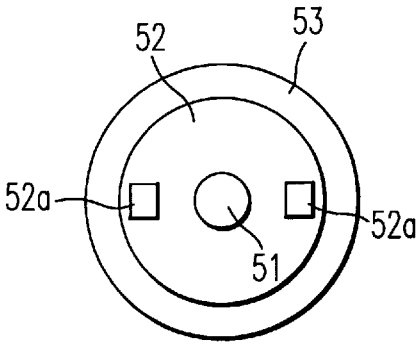
FIGS. 6(*a*) and (*b*) are schematic drawings illustrating a state where a cover is removed from a sheet feed roller, from the front and side in the second embodiment.
Figure 6B:
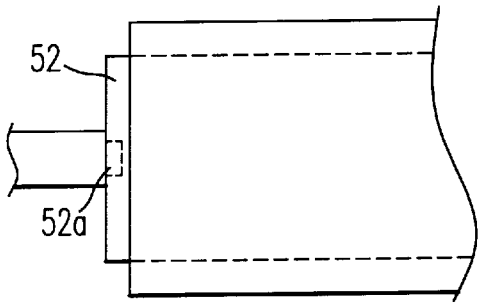
Figure 7A:
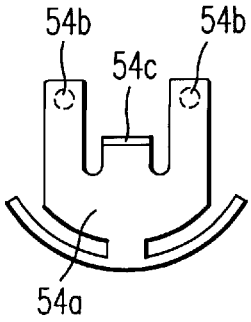
FIGS. 7(*a*) and (*b*) are schematic drawings illustrating the cover, from the front and side in the second embodiment.
Figure 7B:
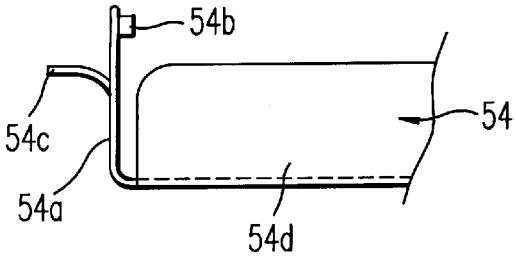

FIG. 5, FIGS. 6(*a*), (*b*), FIGS. 7(*a*) and (*b*) show a sheet-feeding device of the second embodiment.

The sheet feed roller 50 has a shaft 51 made of conductive material, a core 52 formed on the shaft 51, a rotary body 53 which is a columnar roll formed on the core 52 and the cover 54 which is fixed on a surface of the rotary body 53.

The cover 54 has a fan-shaped portion 54*d* extending along the circular surface of the roller portion 53 and planar pieces 54*a* having an edge curved in correspondence with the shape of the fan-shape portion 54*d*. The planar pieces 54*a* are each formed with three-forked portions. Both outer ones of the three-forked portions have a ridge 54*b* on the inner surface of its end. The middle side portion of three-forked portions has a projection 54*c* in its end.

Two holes 52*a* that engage with the ridges 54*b* are formed on the core 52. The projections 54*c* each engages with the holes 52*a*. The elastic body 53 presses against the cover 54 in a direction indicated by an arrow E (see FIG. 5). Consequently, the cover 54 is fixed on the surface of the rotary body 53. Further, the projection 54*c* engages the shaft 51, thereby electrically connecting the two.

As stated above, in the illustrated embodiments, a conventional sheet feed roller is fitted with the cover 43. This decreases the number of the portions of the sheet feed device and accordingly construction can be simplified to accomplish a reduction of the cost of the apparatus.

The sheet feeding operation will be described hereinafter.

When the cassette 21 is set in the laser printer 11, the friction pad 24 engages the surface of the fan-shape portion 43*d* of the sheet feed roller 22. The friction pad 24 pressure against the sheet feed roller 22 is determined by a pressure spring (not shown) and is applied evenly to the sheet feed roller 22. The bottom plate 23 is also lifted up when the cassette 21 is set, and the leading edge of the sheet stack engages and is pressed against the sheet feed roller 22 by a preselected pressure.

When a print start key (not shown) is turned on, the sheet feed roller 22 starts rotating in the direction A. When the surface of the fan-shape portion 43*d* of the sheet feed roller 22 is held in contact with the top sheet P of the sheet stack under the preselected pressure, the top sheet P moves little because the friction force between the fan-shape portion 43*d* and the top sheet of the stack is low. But when the roller 22 has rotated such that the rotary body 42 is in contact with the top sheet P, the top sheet P is driven by the friction between the roller portion 42 made of the high friction material and the sheet P. Accordingly, the top sheet P can be surely fed toward the registration rollers 28.

Sometimes sheets tend to stick together due to static electricity or poorly cut edges. When this happens, two or more sheets may feed between the rotary body 42 and the friction pad 24. However, the friction between the friction pad 24 and the lower sheet is much greater than that between the two sheets, so the top sheet slips through while the pad 24 holds the lower sheet. Therefore, during the sheet feed, the top sheet is separated from the stack and fed to the registration rollers.

The sheet feed roller 42 rotates for one revolution, at which time the top sheet P sent out from the cassette 21 has reached the registration rollers 28. A trailing edge of the top sheet P is then held between the friction pad 24 and the fan-shape portion 43*d* of the sheet feed roller 22 by the preselected pressure, in preparation for feeding to the transfer area. While the rotary body is described as making one rotation, it may instead make two rotations or more, if desired.

The registration rollers 28 then start rotating in synchronism with the moving toner image on the photoconductive member 12, and send the top sheet P thus held to the transfer area. At that time, the trailing edge of the top sheet P is held between the friction pad 24 and the fan-shape portion 43*d* of the sheet feed roller 22 by the preselected pressure. However, since the friction force between the moving trailing edge of the top sheet P and the fan-shape portion 43*d* made of the low friction material is low, the top sheet P can be smoothly fed toward the transfer area by the registration rollers 28.

Further, the pressure between the friction pad 24 and the sheet feed roller 22 is prevented from changing during the sheet feeding operation because the contact between them is held stable. This prevents the two or more top sheets P to be sent out toward the registration rollers 28 from sticking together. Consequently, in the illustrated embodiment, the top sheets P can be surely fed one by one toward the transfer area.

Further, the trailing edge of the top sheet P is held in contact with the cover 43 under the preselected pressure and moved toward the transfer area by the registration rollers 28 after the sheet feed roller 42 stops rotating. However, at that time the trailing edge of the top sheet P is prevented from charging due to friction because the cover 43 is made of the conductive material. Consequently, the illustrated embodiment is capable of producing attractive transfer images.

Figure 8:
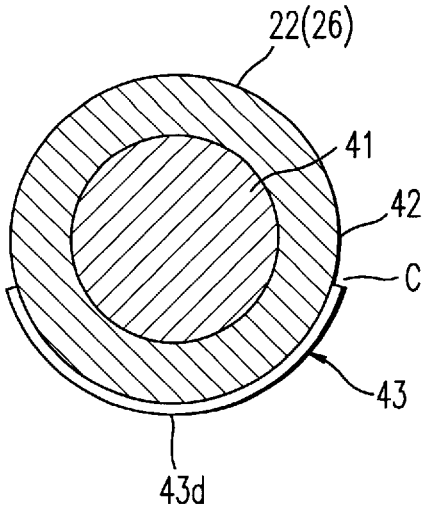
FIG. 8 is a schematic drawing illustrating a difference in level between a surface of the rotary body and the cover on a surface of a sheet feed roller.

FIG. 8 shows a state in which there is a difference in level C between a surface of the rotary body 42 and the cover 43 on the surface of the sheet feed roller 22.

Figure 9:
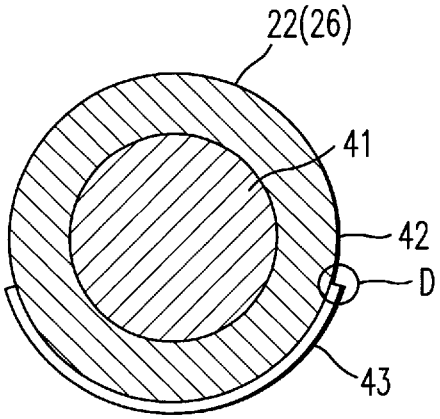
FIG. 9 is a schematic drawing illustrating the absence of a difference in level between the surface of the rotary body and the cover on the surface of a feed roller.
Figure 10:
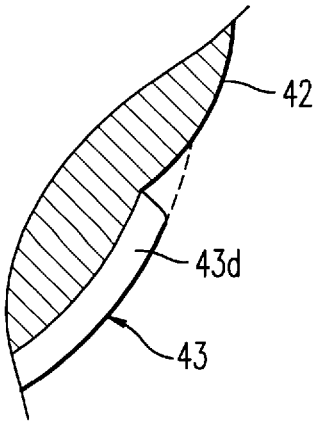
FIG. 10 is an enlarged drawing illustrating region D with FIG. 9.
Figure 11:
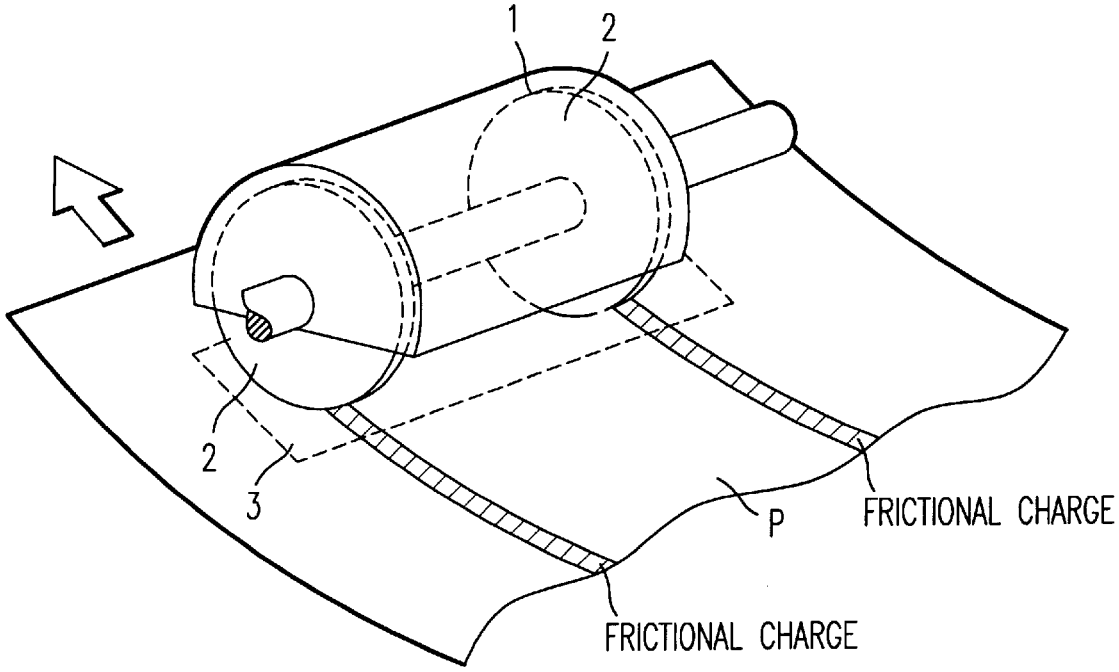
FIG. 11 is an enlarged perspective drawing illustrating a friction charge being formed on a sheet by a conventional a sheet feed device.
Figure 12:
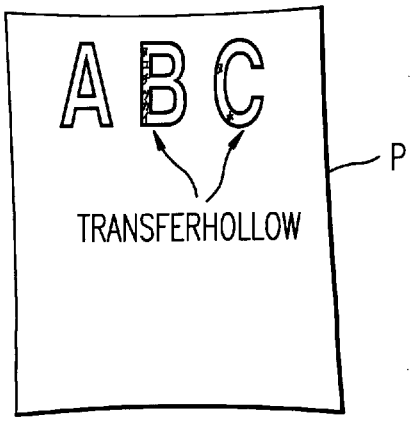
FIG. 12 is a schematic drawing illustrating the result of an unsatisfactory image transfer onto the sheet.

FIG. 9 shows a state in which there is no difference in level between the surface of the rotary body 42 and the cover 43 on the surface of the sheet feed roller 22. FIG. 10 is an enlarged drawing illustrating a portion D of FIG. 9.

As shown in FIG. 8, if there is an extremely noticeable difference in level C on the surface of the sheet feed roller 22, there exists a possibility that the sheet feed roller 22 will fail to sufficiently feed the sheet, resulting in a defective sheet separation. Accordingly, as shown in FIG. 9 and FIG. 10, a leading edge or a trailing edge of the fan-shape portion 43*d* is bent radially inward from a circular arc, and so bites the surface of the rotary body 42. Thus the sheet feed roller 22 achieves a substantially smooth outer circumferential surface. As an alternative, a substantially smooth outer circumferential surface can be achieved without bending the leading or trailing edge of the fan-shape portion 43*d*, by pressing the entire fan-shape portion 43*d* onto the rotary body 42 with a higher pressure.

Various modifications will become possible for those skilled in the art after receiving the teachings of the present disclosure without departing from the scope thereof.

The above-mentioned embodiment has been explained with a structure and an arrangement of the sheet feed roller 22, but may also be suitably selected in matching relation to various condition including sheet feeding conditions.

The above-mentioned values of coefficient of friction of the cover 43 or the rotary body 42 may also be suitably selected in matching relation to various condition including sheet feeding conditions.

The above-mentioned values of electric resistance of the cover 43 or the rotary body 42 may also be suitably selected in matching relation to various condition including sheet feeding conditions.

The above-mentioned arrangement of the cover 43 may also be suitably selected in matching relation to various condition including sheet feeding conditions.

The covering member described above is implemented as the cover 43, but it may be implemented as seals made of a conductive material or a low friction material, tapes made of a conductive material or a low friction material or similar members, if desired.

The sheet-feeding device have been shown and described as being used for copiers, facsimiles, printers or similar image forming apparatus. However, the invention is similarly applicable to any kind of sheet feeding device for various apparatus (e.g., printing presses, cash dispensers or similar apparatus).

What is claimed is:

1. A member for feeding sheets, comprising:

a core;

a cylindrical surface formed on said core so as to be rotatable, said cylindrical surface being made of a material whose coefficient of friction is higher than that of sheets to be fed; and a cover member made of a material whose coefficient of friction is lower than that of the sheets to be fed, said cover member comprising a fan-shaped portion curved to extend along said cylindrical surface.

2. The member for feeding sheets according to claim 1, wherein said cover member is formed of one taken from the group consisting of metal, resin, ceramics and glass.

3. The member for feeding sheets according to claim 1, wherein said surface is formed of rubber.

4. A member for feeding sheets, comprising:

a core having a rotatable surface, wherein a surface portion which is less than an entirety of said surface, is made of a conductive material.

5. The member for feeding sheets according to claim 4, wherein said cover member is formed of one taken from the group consisting of metal, resin, ceramics and glass.

6. The member for feeding sheets according to claim 4, wherein said cover member is formed of a material having the electric resistance of $1\times10^{12}\Omega$ or less.

7. A member for feeding sheets, comprising:

a core comprising a roller having a peripheral surface whose coefficient of friction is higher than that of sheets to be fed; and a cover member mounted to said core such that said cover member substantially coincides with a circumferential portion of the peripheral surface of said roller, wherein said cover member is made of a material whose coefficient of friction is lower than that of the sheets to be fed.

8. A member for feeding sheets, comprising:

a core comprising a roller having a peripheral surface whose coefficient of friction is higher than that of sheets to be fed; and a cover member mounted to said core such that said cover member substantially coincides with a circumferential portion of the peripheral surface of said roller, wherein said cover member is made of a conductive material whose coefficient of friction is lower than that of the sheets to be fed.

9. A sheet feeding device comprising:

a cassette to hold a stack of sheets;

a sheet feed member mounted so as to feed sheets one by one from said cassette, said sheet feed member including a core comprising a roller having a peripheral surface whose coefficient of friction is higher than that of the sheets to be fed, and a cover member mounted to said core such that said cover member substantially coincides with a circumferential portion of the peripheral surface of said roller, wherein said cover member is made of a material whose coefficient of friction is lower than that of the sheets to be fed; and a friction member mounted so as to be pressed against said sheet feed member.

10. A sheet feeding device comprising:

a cassette to hold a stack of sheets;

a sheet feed member mounted so as to feed sheets one by one from said cassette, said sheet feed member including a core comprising a roller having a peripheral surface whose coefficient of friction is higher than that of the sheets to be fed, and a cover member mounted to said core such that said cover member substantially coincides with a circumferential portion of the peripheral surface of said roller, wherein said cover member is made of a conductive material whose coefficient of friction is lower than that of the sheets to be fed; and a friction member mounted so as to be pressed against said sheet feed member.

11. An image forming apparatus including a sheet feeding device comprising:

a cassette to hold a stack of sheets;

a sheet feed member mounted so as to feed sheets one by one from said cassette, said sheet feed member including a core comprising a roller having a peripheral surface whose coefficient of friction is higher than that of the sheets to be fed, and a cover member mounted to said core such that said cover member substantially coincides with a circumferential portion of the peripheral surface of said roller, wherein said cover member is made of a material whose coefficient of friction is lower than that of the sheets to be fed; and a friction member mounted so as to be pressed against said sheet feed member.

12. An image forming apparatus including a sheet feeding device comprising:

a cassette to hold a stack of sheets;

a sheet feed member mounted so as to feed sheets one by one from said cassette, said sheet feed member including a core comprising a roller having a peripheral surface whose coefficient of friction is higher than that of the sheets to be fed, and a cover member mounted to said core such that said cover member substantially coincides with a circumferential portion of the peripheral surface of said roller, wherein said cover member is made of a conductive material whose coefficient of friction is lower than that of the sheets to be fed; and a friction member mounted so as to be pressed against said sheet feed member.

13. A member for feeding sheets, comprising:

a core; and a surface portion formed on said core so as to be rotatable, at least one portion of the circumferential extent said surface portion being made of a conductive material whose coefficient of friction is lower than that of sheets to be fed and at least another portion of the circumferential extent said surface portion being made of a non-conductive material whose coefficient of friction is higher than that of the sheets.

14. The member for feeding sheets according to claim 13, wherein said portion being made of said conductive material comprises a cover member.

15. The member for feeding sheets according to claim 14, wherein said cover member is fixed on a part of said surface portion and includes a fan-shaped portion curved to extend along said surface portion.

* * * * *